US010547929B2

(12) United States Patent
Santhuff

(10) Patent No.: US 10,547,929 B2
(45) Date of Patent: Jan. 28, 2020

(54) EARBUD WRAP

(71) Applicant: Bruce R. Santhuff, Wilmington, NC (US)

(72) Inventor: Bruce R. Santhuff, Wilmington, NC (US)

( * ) Notice: Subject to any disclaimer, the term of this patent is extended or adjusted under 35 U.S.C. 154(b) by 0 days.

(21) Appl. No.: 16/057,888

(22) Filed: Aug. 8, 2018

(65) Prior Publication Data

US 2019/0208305 A1 Jul. 4, 2019

Related U.S. Application Data

(60) Provisional application No. 62/612,230, filed on Dec. 29, 2017.

(51) Int. Cl.

| | |
|---|---|
| ***H04R 1/10*** | (2006.01) |
| ***H04R 5/033*** | (2006.01) |
| ***A45F 5/00*** | (2006.01) |
| ***B65H 75/44*** | (2006.01) |

(52) U.S. Cl.

CPC ..... *H04R 1/1033* (2013.01); *A45F 5/00* (2013.01); *B65H 75/4418* (2013.01); *H04R 1/105* (2013.01); *H04R 5/033* (2013.01); *A45F 2200/0508* (2013.01); *H04R 1/1016* (2013.01); *H04R 1/1066* (2013.01)

(58) Field of Classification Search

CPC ..... H04R 1/1016; H04R 1/1033; H04R 1/02; H04R 1/1066

USPC ..... 381/380, 384, 386, 388

See application file for complete search history.

(56) References Cited

U.S. PATENT DOCUMENTS

| | | | | |
|---|---|---|---|---|
| 5,116,059 | A * | 5/1992 | Pelletier | A63B 69/0079 473/147 |
| 2007/0102990 | A1* | 5/2007 | Smith | B60N 2/2812 297/484 |
| 2014/0376763 | A1* | 12/2014 | Stevinson | A45C 11/00 381/370 |
| 2015/0236745 | A1* | 8/2015 | Tranchida | A45C 11/00 455/575.8 |
| 2016/0050481 | A1* | 2/2016 | Moats | H04R 1/1033 381/384 |
| 2016/0080851 | A1* | 3/2016 | Sumsion | H04B 1/086 381/74 |
| 2017/0210591 | A1* | 7/2017 | Kennedy | B65H 75/4473 |
| 2018/0053491 | A1* | 2/2018 | Spangler | G10D 1/08 |

* cited by examiner

*Primary Examiner* — Alexander Krzystan
(74) *Attorney, Agent, or Firm* — William Gray Mitchell

(57) ABSTRACT

The invention is a collapsible cord wrapping device for clipping onto the cords of earbuds or similar devices when in use, which device can be unfolded for use as a cord wrapping base during earbud storage to prevent tangling.

13 Claims, 10 Drawing Sheets

EARBUD WRAP

CROSS REFERENCE TO RELATED APPLICATIONS

This application claims priority to U.S. provisional patent application 62/612,230, filed on Dec. 27, 2017 and incorporated herein by reference.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The invention is an earbud wrap device for storing earbud cords when not in use.

Background of the Invention

The use of headphones, earphones, earbuds and other corded-connection devices by users for listening to music, telephone calls and other audio purposes is well known. Such audio listening devices are connected by cords to devices providing an audio stream, whether cell phones, MP3 players, tablets or other, similar devices that allow the user to use the device when traveling from place to place.

Stowing a listening device between uses or during travel often results in the tangling of the cord. Typical locations for such storage are in pockets, backpacks, briefcases or other, similar spaces that involve shifting and twisting during transportation. The result of these forces on a corded device is that the cord, no matter how carefully coiled prior to insertion into the travel space, is invariably tangled and/or knotted upon removal, and will take seconds or longer to untangle before use can begin. Due to the fact that each earpiece is independent, the tangling factor with earbuds is especially severe. For many users, the exercise of untangling earbuds is repeated several times over the course of each day.

Due to the prevalence of the problem, a number of devices have been marketed with the intent of combating earbud tangling. Such attempts have thus far been imperfect, however, due to imperfections in the means of attachment to and securing of the cords to be protected. One such invention is disclosed in U.S. Pat. No. 9,445,180 to Tite, which lacks both a permanent or semipermanent attachment method for the cords, allowing for parts to be lost or misplaced, as well as a mechanism to expand for winding and retract for temporary storage on the cord during use.

BRIEF SUMMARY OF THE INVENTION

In a preferred embodiment, a cord wrapping device comprising a front panel and back panel, one or more cord clips, a retraction mechanism, a side slot and at least two end slots.

In another preferred embodiment, the cord wrapping device as described herein, wherein the retraction mechanism is a single, circular hinge running through each panel and about which each panel may rotate.

In another preferred embodiment, the cord wrapping device as described herein, wherein the retraction mechanism is at least one interlocking channel integrated into each panel and allowing the panels to slide, thereby extending and retracting past one another.

In another preferred embodiment, the cord wrapping device as described herein, wherein the retraction mechanism is at least one door-style hinge attached to a corresponding edge of each panel and allowing the panels to fold over one another.

In another preferred embodiment, the cord wrapping device as described herein, further comprising a central component, such central component comprising a front piece and a back piece, wherein an inward-oriented face of each such front piece and back piece, as well as an outward-oriented face of the front panel and back panel, together form an interlocking channel serving as a retraction mechanism.

In another preferred embodiment, the cord wrapping device as described herein, further comprising a spring-loading mechanism comprising at least one spring attached to a spring cradle within each panel, allowing the spring to compress and the panels to be secured by at least one hook, clasp or buckle to securely hold the device in its compressed configuration, wherein such hook or clasp may be released to allow the spring to expand the device.

In another preferred embodiment, the cord wrapping device as described herein, wherein the hook or clasp is embodied as a buckle on one panel and a corresponding buckle slot on the other panel, such that the buckle partially protrudes through the buckle slot when the device is compressed.

In another preferred embodiment, the cord wrapping device as described herein, wherein the device is made of plastic or aluminum.

In another preferred embodiment, the cord wrapping device as described herein, wherein the device is designed to look like a familiar object or animal.

In another preferred embodiment, the cord wrapping device as described herein, wherein the cord clips are each a L-shaped or U-shaped extension of the panel body with a first and second end, wherein the first end is attached to the panel body and the second end is not attached to the panel body.

In another preferred embodiment, the cord wrapping device as described herein, wherein the cord clips are each comprised of cord, string or a similar material, which is securely threaded through two holes in the corresponding panel component.

In another preferred embodiment, the cord wrapping device as described herein, wherein the side slot is replaced with a side clip.

In an alternate preferred embodiment, a method of using the cord wrapping device as described herein, consisting of the steps of: securing an earbud cord to the wrapping device using the clips, expanding the wrapping device using the retraction mechanism, wrapping the cord around the device using the end slots, and securing each end of the earbud cord within the side slot.

DETAILED DESCRIPTION OF THE INVENTION

Figure 1A:
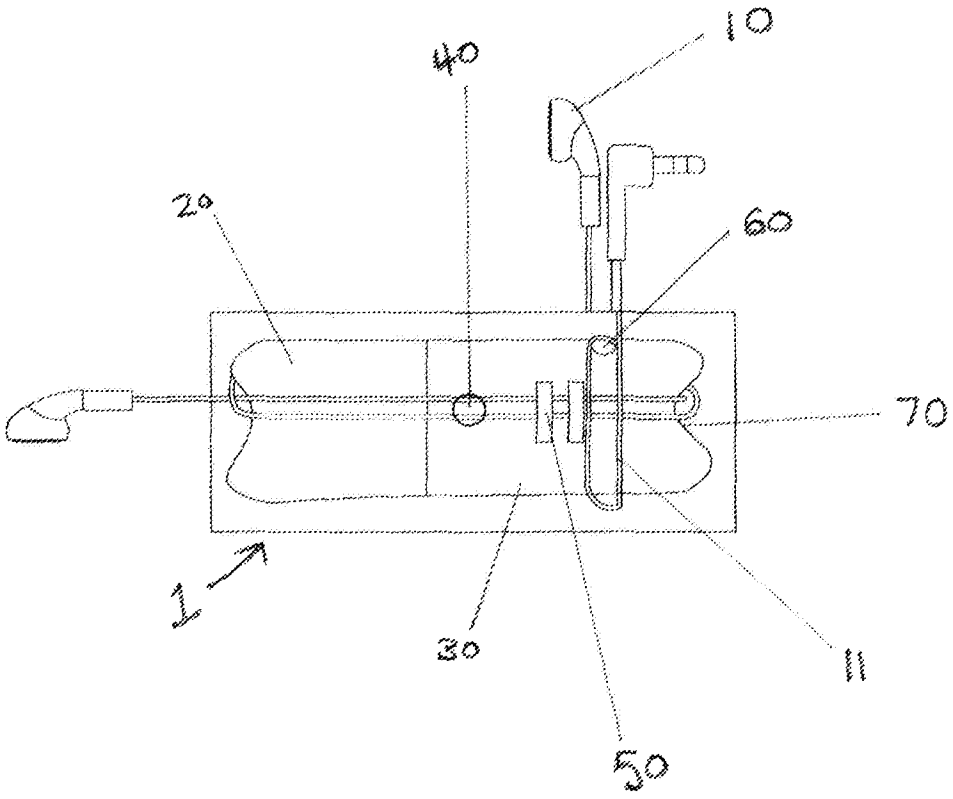
FIG. 1A is a line drawing evidencing a first embodiment of a cord wrapping device.

The invention constitutes an earbud wrap device that is collapsible or contractible, comprising a clip or clips for attachment to the cord of a set of earbuds or earphones. The wrap device is configured so that it may be semipermanently or removably attached to such cord and either expanded or contracted according to the state of use of the earbuds.

While the earbuds are actively in use, the wrap device may be contracted so that it may hang along with the cord. In such contracted state, the wrap device will remain at hand on the cord and ready to store the cord immediately upon the user's completion of use.

When use of the earbuds has been completed, the user may remove the earbuds from his or her ears, and immediately commence to expand the wrap device, thereby allowing the user to wrap the earbud cord around the wrap device for tangle-free storage. The wrap device may be expanded or contracted by a plurality of mechanisms, including but not limited to sliding, rotating or folding. In any event, the device will comprise two or more separate panels, including at least a front panel and back panel, which overlap when in the contracted position and are arranged approximately side-by-side when in the expanded position.

Telescopic-style expansion by sliding could be accomplished by the use of interlocking channels integrated into each of the front and back panel. In one embodiment, such interlocking channels would be embodied as a male part on one panel and corresponding female part on the other panel. Such channels would be fully engaged in the closed or retracted position, such that the panels fully overlay one another, while in the open or expanded position only a portion the channels would overlay, allowing most of the two panels to extend past one another. In another preferred embodiment, a two-piece central component will overlay each of the front and back panels, with channels located on the inner side of each central component piece and corresponding to channels on the outer side of each panel, allowing the panels to retract inside the central component and then extend outward for winding the cord.

In another embodiment, the telescopic expansion is facilitated by a spring-loaded mechanism, whereby a hook, clasp or similar mechanism is engaged to hold the panels together in the retracted position. Preferably, the spring would be located inside or around a spring rail attached immovably to one panel and moveably to the other panel, allowing the panels to slide away upon extension of the spring. When the user desires expansion, a buckle, lever or slide is engaged to withdraw the hook, allowing the spring(s) to automatically slide the panels into the expanded position. The next retraction would then be accomplished by manually squeezing the panels back together, which motion would reengage the hook or clasp. In a preferred embodiment, the hook or clasp is embodied as a button or buckle arranged on one or both sides of the back panel of the device, with the back panel sliding partially within a hollow front panel, and such button or buckle exerting an outward pressure such that it protrudes partly through a corresponding slot in the side(s) of the front panel when fully contracted. The protrusion of the button or buckle through the slot would then preclude a reopening of the device until a user initiated disengagement by pushing inwards on each such button or buckle.

Expansion by rotation would be accomplished by a pin or screw extending through one end of each of the back and front panel and acting as a hinge, such that one or both panels could be rotated about such hinge to overlay one another in a closed position or to extend outward past one another in an open position.

Extension by folding would be accomplished through the attachment of one or more door-type hinges to corresponding edges of the back and front panels. The hinge(s) would then allow the two panels to swing open or closed in relation to one another, as a door swings open or closed.

In a preferred embodiment, one of the two panels of the wrap device would comprise one or more clip components for securing the device to the earbud cord to one face of the device. In a more preferred embodiment, two clips are arranged side-by-side and centered on the face of the front panel for establishing a stable cord connection. Such clips may either be integrated within the panel itself or adhered thereto. For example, in a plastic panel made by an injection-molding or similar process, such clips may be created as a part of the mold. Such clips would be roughly u-shaped and permanently attached to the panel face on one side, while remaining flush with the panel face but unattached on the other side, thus creating a rectangular space within the clip and the panel face. To engage the cord, the unattached side could be manually pulled open wide enough to slide in the cord, with the plastic returning to its original position flush against the panel face upon release. In another preferred embodiment, the clips could each include a second protrusion from the panel face on the unattached side, with such protrusion and the corresponding end of the clip feature each containing a lip or shelf to allow for interlocking.

In another embodiment of the clip design, each clip may be created by threading of a separate component through holes stamped in the panel. One such mechanism could be a clip made of natural or synthetic rubber or flexible plastic, shaped as a belt with a closing mechanism and threaded through two holes in the panel. Such closing mechanism could be embodied as a clasp, male and female interlocks, hook and loop material, or another commercially known fastening mechanism. Alternatively, a separate component clip could be adhered to the panel face with any appropriate commercial adhesive. Such a separate clip could be any known hard or soft clip design, including but not limited to a standard binder clip, clothespin, safety pin, cotter pin, retaining ring, rounded locking pin, or any soft belt design. Another alternative design would use a "bobby pin" style of metal clip with one or more molded depressions, wherein the cord passes under one such depression and is corralled between it and the panel face.

Since it is intended that the wrap device will hang from the earbud cord during use, it is necessary that it be lightweight. Rigid materials such as plastic or aluminum would be preferred. Types of plastic for use may be taken from the group comprising, without limitation, polyethylene terephthalate (PET), high density polyethylene (HDPE), polyvinyl chloride (PVC), low density polyethylene (LDPE), poly propylene or polystrene. Rubberized coating of the entire panels or edging around all or a part of each panel could also be applied to better hold the cord as it comes in contact through wrapping or winding. Alternatively, a more rubber-like composition could be used to form the entire device. Examples of such rubber-like material would include, without limitation, natural rubber, chlorosulfonated polyethylene, fluoroelastomers, polychloroprene or neoprene, silicon rubber and styrene butadiene rubber.

Regardless of the means of clipping or retraction, the wrap device will have one side slot and two end slots for securing the cord during wrapping. The side slot will preferably be relatively narrow, deep and contain a side slot angle, such that the cord end(s) may be secured within such side slot when the cord is wrapped. In another embodiment, the side slot may be replaced with another clip from one of the designs disclosed herein above and located at a side edge of the panel. The end slots will function as depressions within the outer edges of each of the front and back panels to capture each cord loop as the winding occurs.

The wrap device invention lends itself to an unlimited number of ornamental designs for marketing purposes, wherein the device is designed as a recognizable shape or two-dimensional version of an object, such as an animal, insect or flower. Likewise, an unlimited number of colors or color patterns could be employed.

DETAILED DESCRIPTION OF THE FIGURES

FIG. 1A is a line drawing evidencing a first embodiment of a cord wrapping device 1, comprising a front panel 20 and back panel 30, a single hinge 40 around which the two panels rotate, two clips 50 located on a face of the back panel 30, a side slot 60 and two end slots 70. As illustrated, the end of the earbud cord 11 will be captured within the side slot and side slot angle 61, while the loops of the wrapped cord 11 will be coiled within the end slots 70 and around the panels 20, 30. The hinge in this embodiment may preferably be embodied as a pin, bolt or screw.

Figure 2A:
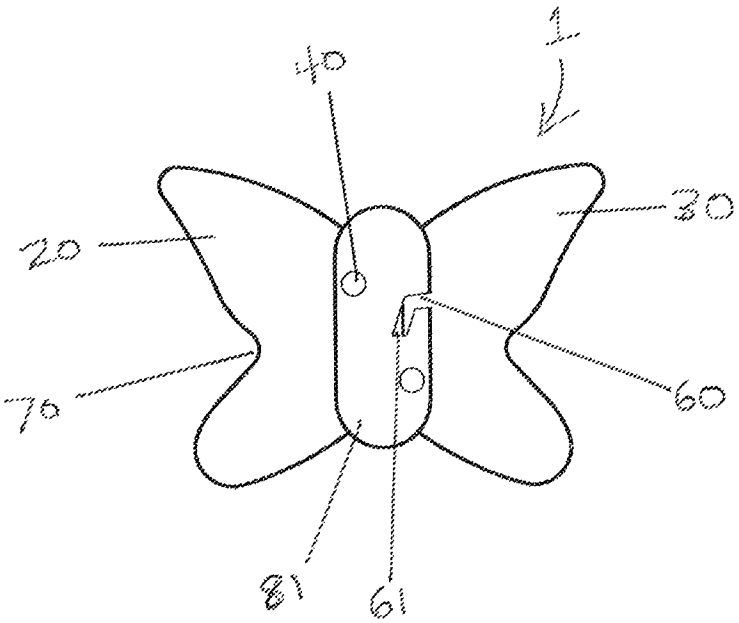
FIG. 2A is a line drawing evidencing front view of a second embodiment of a cord wrapping device.
Figure 2B:
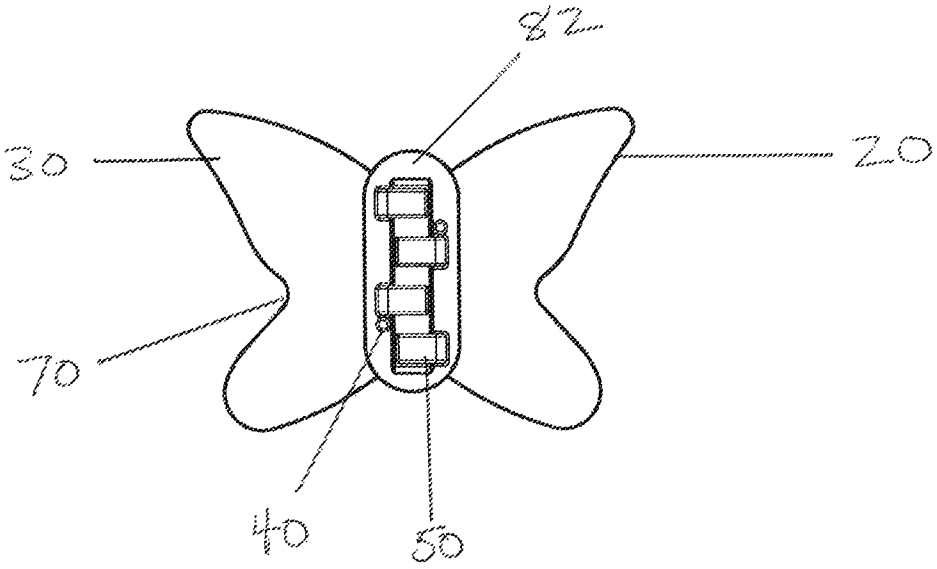
FIG. 2B is a line drawing evidencing a rear view of the embodiment of FIG. 2A.

FIGS. 2A and 2B are line drawings evidencing a second embodiment of a cord wrapping device 1, including a central component 80, itself comprised of a combination of front central component 81 and back central component 82. In FIG. 2A, a front view of this embodiment is pictured comprising a back panel 20, front panel 30, front central component 81, end slots 70 and side slot 60 with a slide slot angle 61.

Figure 1B:
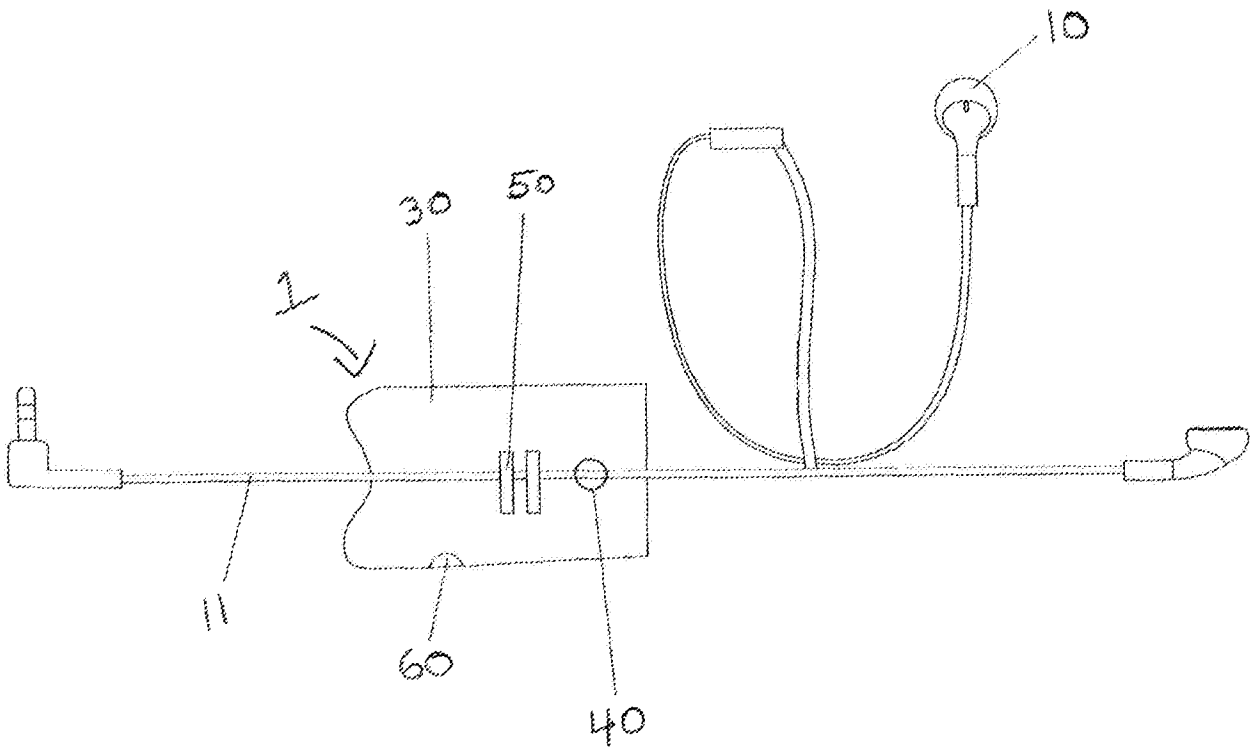
FIG. 1B is a line drawing evidencing the embodiment of FIG. 1A when swiveled closed.

FIG. 2B shows a rear view with front panel 30, back panel 20, back central component 81 with a plurality of central component clips 83. As with the first embodiment of FIG. 1, the loops of a wrapped cord 11 would circumnavigate the wrapping device within the end slots 70, while being semi-permanently secured within the central component clips, with the end of such cord would be secured within side slot and side slot angle 60, 61. In the embodiment of FIGS. 2A and 2B, each of the front panel 20 and back panel 30 would rotate about hinge 40 to retract within the central component 80, allowing for a reduced profile of the wrapping device when the earbuds are in use. When use ends and the user is ready to wrap the cord, the front and back panels may be rotated outward to increase the device profile and increase ease of wrapping.

In the pictured embodiment of FIG. 2B, the central component clips are embodied as u-shaped components emanating from the central component, wherein a first end of each such clip is integral with the central component, and a second end is unattached to the central component, leaving it open so that the cord may be slipped under such second end and within the body of the clip. In another embodiment, a line of such clips may be separately manufactured such that the line of clips may be adhered, screwed or otherwise mounted upon the central component.

Figure 2C:
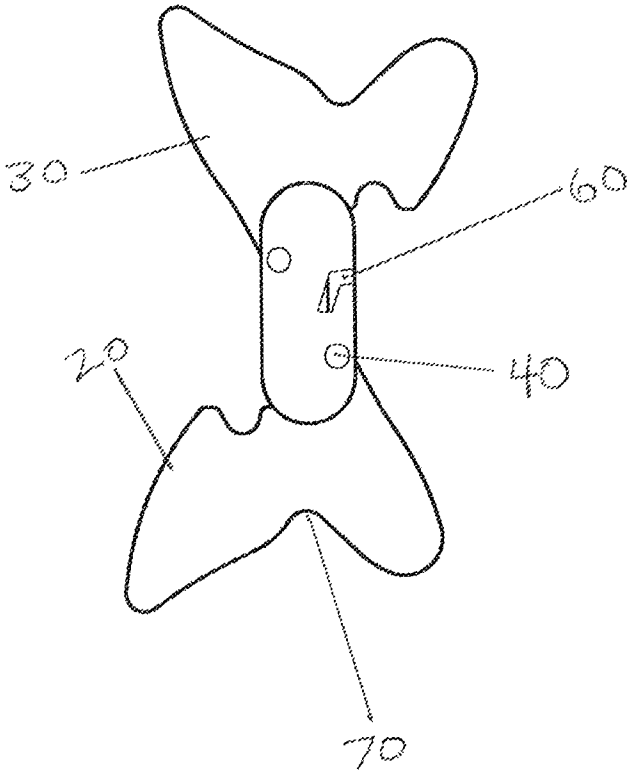
FIG. 2C is a line drawing evidencing a view of the embodiment of FIG. 2A when expanded.

FIG. 2C evidences a view of front and rear panels 30, 20 in the extended position, each having been rotated about its corresponding hinge 40, thereby allowing for a wrapping of the cord 11 (not pictured) when the earbuds are not in use.

Figure 3A:
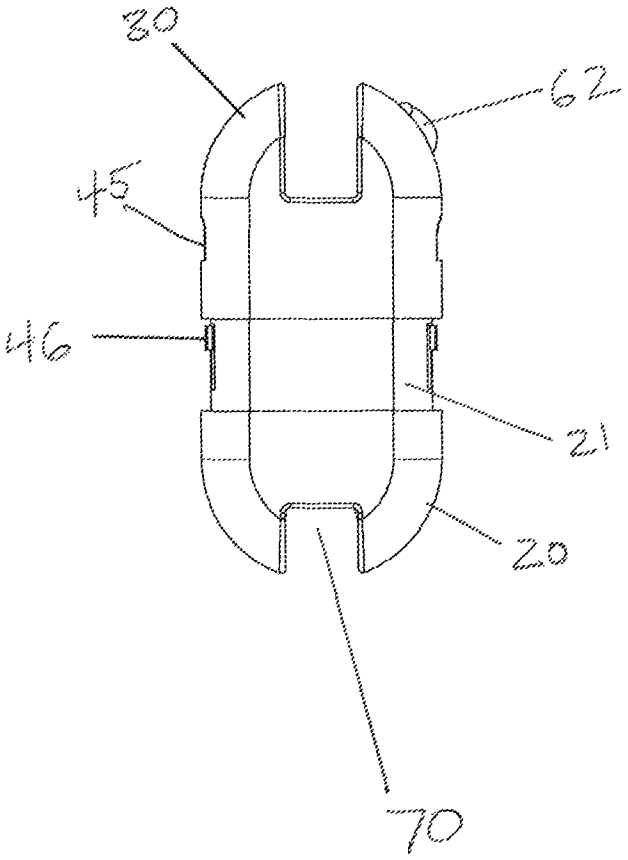
FIG. 3A is a line drawing evidencing a front view of a third embodiment of a cord wrapping device.
Figure 3B:
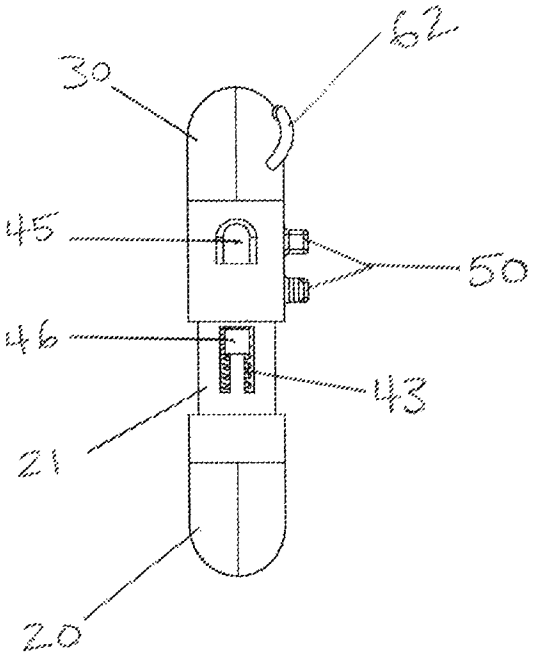
FIG. 3B is a line drawing evidencing a side view the embodiment of FIG. 3A.
Figure 3C:
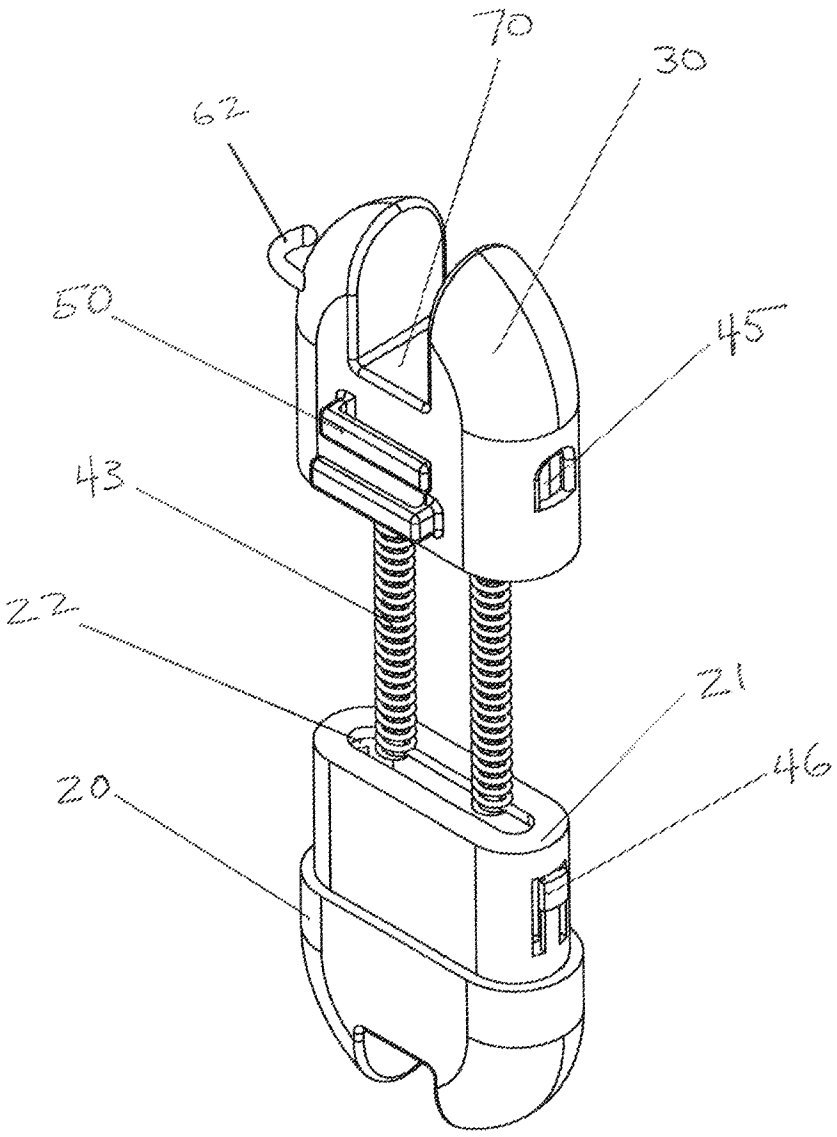
FIG. 3C is a line drawing evidencing an exploded view of the embodiment of 3A.

FIGS. 3A-3C are line drawings evidencing a third embodiment of a cord wrapping device 1, wherein the two panels slide together and apart with a spring-loading mechanism. In FIG. 3A, the rear side of the embodiment is pictured in a see-through view, evidencing front panel 30 and back panel 20 in an open position and two springs 43 passing within the space inside the two panels. In this embodiment, the wrapping device is in its closed configuration, wherein it can dangle from the cord during use by using the clips. Located on the outer edge of the embodiment resides a side clip 62.

In FIG. 3B, a side view, buckle slot 45 in front panel 30 and buckle 46 in back panel 20 are prominently shown in the sides, while spring 45 is visible inside. Clips 50 are shown on the top of the device for securing the cable.

In FIG. 3C, a perspective, exploded view of the embodiment is shown, with front panel 30 and back panel 20, each hollow and together containing two springs 43 extending within and between the panels and allowing for the spring-loading of the two panels when compressed and locked with buckle slot(s) 45 and buckle(s) 46. The back panel projection 21 shows a smaller circumference than does the end of back panel 20, allowing the back panel projection to slide into the front panel 30 and each buckle and buckle slot to engage when the device is compressed. Each panel comprises a hollow interlocking channel 41 within. When the device is in the compressed state, each buckle can then be pressed and released from the corresponding buckle slot, the springs will automatically extend the panels 20, 30 into the open position as shown, thereby allowing the earbud cord (not pictured) to be wrapped around end slots 70, which in this embodiment are located within the confines of two end hooks 71, each emanating from a distal corner of one of the two panels. The earbud cord may further be secured within the clip 50 located on the face of the front panel.

In this embodiment, it is considered that a spring cradle 44 (not pictured), embodied as a small hole will be bored in the interior end of each panel and correspond to the circumference of each spring 43, such that the spring may be adhered within such hole using a commercially acceptable adhesive, pins, or may be frictionally secured by insertion into a molded plastic channel integral with the panel. Alternatively, the springs may be manufactured with screw-type end pieces, which could be screwed into the spring hole.

Figure 4A:
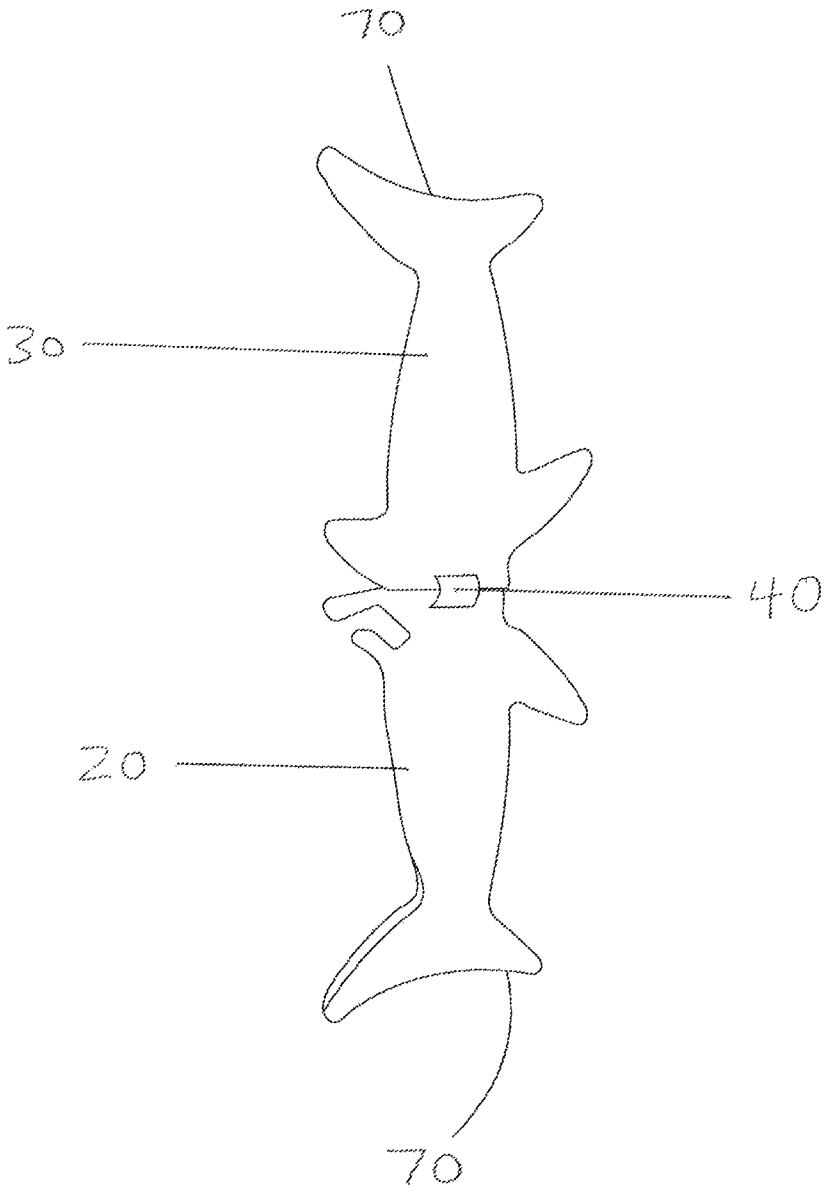
FIG. 4A is a line drawing evidencing a fourth embodiment of a cord wrapping device when open.
Figure 4B:
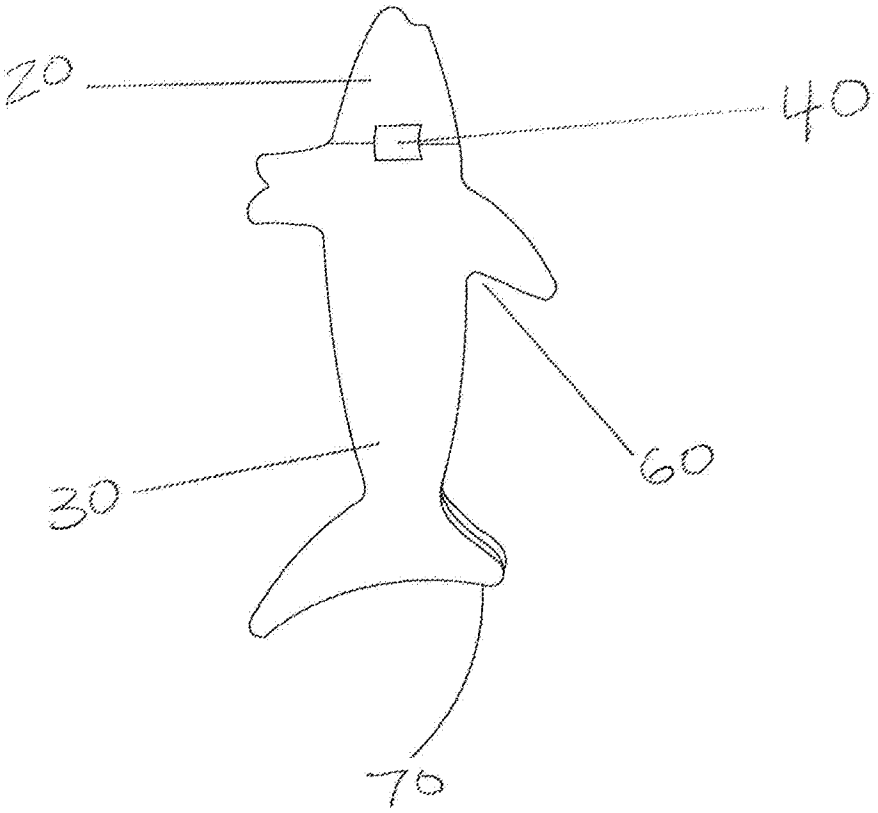
FIG. 4B is a line drawing evidencing the embodiment of FIG. 4A when closed.

FIG. 4A evidences another embodiment of the wrapping device 1, this time utilizing a door-style hinge 42 to expand and contract, wherein the back panel 20 and front panel 30 can be swung to overlay one another in the contracted configuration. FIG. 4B evidences the embodiment shown in FIG. 4A, this time in a position with the door-style hinge shut and the two panels overlapping.

For purposes of reference, it should be noted that each of the hinge 40, interlocking channel 41, door-style hinge 42 and spring/buckle 43/46 are also interchangeably referred to herein as a retraction mechanism. Alternative forms of retraction mechanism also may be implied throughout this document. I would further note that, in addition to the exemplary embodiment shown in FIGS. 1A-4B, other related designs of wrapping device are also possible without deviating from the fundamental idea of the present invention.

LIST OF REFERENCE NUMBERS

1 wrapping device
10 earbuds
11 earbud cord
20 back panel
21 back panel extension
30 front panel
40 hinge
41 interlocking channel
42 door-style hinge
43 spring
44 spring cradle (optional)
45 buckle slot
46 buckle
50 clip
60 side slot
61 side slot angle
62 side clip
70 end slots
80 central component
81 front central component
82 back central component
83 central component clips The references recited herein are incorporated herein in their entirety, particularly as they relate to teaching the level of ordinary skill in this art and for any disclosure necessary for the more common understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

I claim:

1. A cord wrapping device comprising a front panel and back panel, a retraction mechanism, at least two end slots, a first cord clip and a second cord clip, wherein the first and second cord clips are configured together to hang the cord wrapping device from a cord while the cord is in use.

2. The cord wrapping device of claim 1, wherein the retraction mechanism is a single, circular hinge running through each panel and about which each panel may rotate.

3. The cord wrapping device of claim 1, wherein the retraction mechanism is at least one interlocking channel integrated into each panel and allowing the panels to slide, thereby extending and retracting past one another.

4. The cord wrapping device of claim 1, wherein the retraction mechanism is at least one door-style hinge attached to a corresponding edge of each panel and allowing the panels to fold over one another.

5. The cord wrapping device of claim 3, further comprising a central component, such central component comprising a front piece and a back piece, wherein an inward-oriented face of each such front piece and back piece, as well as an outward-oriented face of the front panel and back panel, together form an interlocking channel serving as a retraction mechanism.

6. The cord wrapping device of claim 3, further comprising a spring-loading mechanism comprising at least one spring attached to a spring cradle within each panel, allowing the spring to compress and the panels to be secured by at least one hook, clasp or buckle to securely hold the device in its compressed configuration, wherein such hook or clasp may be released to allow the spring to expand the device.

7. The cord wrapping device of claim 6, wherein the hook or clasp is embodied as a buckle on one panel and a corresponding buckle slot on the other panel, such that the buckle partially protrudes through the buckle slot when the device is compressed.

8. The cord wrapping device of claim 1, wherein the device is made of plastic or aluminum.

9. The cord wrapping device of claim 1, wherein the device is designed to look like an animal.

10. The cord wrapping device of claim 1, wherein the cord clips are each a L-shaped or U-shaped extension of the panel body with a first and second end, wherein the first end is attached to the panel body and the second end is not attached to the panel body.

11. The cord wrapping device of claim 1, further comprising a side slot or clip for securing the cord during wrapping.

12. A method of using the cord wrapping device of claim 1, consisting of the steps of:

securing an earbud cord to the wrapping device using the first and second cord clips, expanding the cord wrapping device using the retraction mechanism, wrapping the cord around the device using the end slots, and securing each end of the earbud cord within the side slot or clip(s).

13. The cord wrapping device of claim 1, wherein the side slot is shaped as a hook or a line with an angled bend.

* * * * *